United States Patent [19]

Hedrick

[11] 3,948,155

[45] Apr. 6, 1976

[54] AIR DIFFUSERS

[75] Inventor: Warren R. Hedrick, Holland, Mich.

[73] Assignee: Allied Thermal Corporation, New Britain, Conn.

[22] Filed: Aug. 12, 1974

[21] Appl. No.: 496,762

[52] U.S. Cl. ..... 98/40 D; 98/114

[51] Int. Cl.[2] ..... F24F 7/00; F24F 13/00

[58] Field of Search..... 98/40 R, 40 D, 40 C, 114, 98/40 DL; 52/303, 484, 731, 732, 476

[56] References Cited

UNITED STATES PATENTS

| | | | |
|---|---|---|---|
| 2,071,865 | 2/1937 | Parsons | 52/484 |
| 2,221,001 | 11/1940 | Lucius | 98/40 D |
| 2,822,741 | 2/1958 | Kennedy | 98/40 D |
| 2,907,260 | 10/1959 | Davies | 98/114 |
| 2,982,197 | 5/1961 | Roberts | 98/40 D |
| 3,217,628 | 11/1965 | Sweeney et al. | 98/40 D |
| 3,232,206 | 2/1966 | Kennedy | 98/40 D |
| 3,264,972 | 8/1966 | Averill et al. | 98/40 D |
| 3,291,028 | 12/1966 | Sylvester et al. | 98/40 D |
| 3,322,056 | 5/1967 | O'Day et al. | 98/40 R |
| 3,363,535 | 1/1968 | Sweeney | 98/40 D |
| 3,373,275 | 3/1968 | High | 98/40 DL |
| 3,403,614 | 10/1968 | Cannes | 98/40 D |
| 3,559,560 | 2/1971 | Traham | 98/114 |

*Primary Examiner*—William E. Wayner
*Assistant Examiner*—Henry C. Yuen
*Attorney, Agent, or Firm*—Johnson, Dienner, Emrich & Wagner

[57] ABSTRACT

An air diffuser embodying a housing, defining an air chamber, adapted to be mounted in a suitable opening in a wall or ceiling of a room, and having an air inlet in one side thereof adapted to be connected to an air duct, or the like, and an air outlet on the opposite side thereof. with a substantially flat air deflector unit extending across the air outlet and defining the outer face of the air diffuser remote from the air inlet, and deflector unit having a plurality of adjustable modules having openings constituted and arranged therein in such a manner as to cause air discharged from the outlet to flow laterally away from the diffuser along the wall or ceiling in which the diffuser is mounted.

14 Claims, 12 Drawing Figures

AIR DIFFUSERS

BACKGROUND OF THE INVENTION

This invention relates to air diffusers, and more particularly, to air diffusers which are particularly well adapted for mounting in a wall or ceiling of a room for discharging air into the room from an air distribution system.

Present day interior designers prefer uniplanar ceilings uninterrupted by anything which protrudes into the room, such as the directional vanes of air diffusers. This brought about the use of perforated plates across the outlet of a diffuser, which achieves the effect desired by the designers, but has the disadvantage of directing air downwardly into a room instead of parallel to the ceiling, which is the desired goal. The present invention is directed to the provision of a panel across the outlet of the diffuser which itself novel directional openings therethrough whereby the air is directed in a plane substantially parallel to the plane thereof as it leaves the diffuser and provides the desired uninterrupted appearance as above mentioned.

It is a primary object to the present invention to afford a novel air diffuser.

Another object of the present invention is to afford a novel air diffuser, which is adapted to be mounted in a wall or ceiling of a room, for discharging air from an air distribution system into the room in a novel and expeditious manner.

A further object is to afford a novel air diffuser of the aforementioned type, wherein the parts thereof are constituted and arranged in a novel and expeditious manner effective to cause the air flowing therefrom to pass in a discharge pattern flowing laterally from the diffuser along the surface of the wall or ceiling in which the diffuser is mounted.

Air diffuser units, the purpose of which is to cause air to be discharged therefrom along a ceiling or wall of a room have been heretofore known in the art, being disclosed, for example, in U.S. Pat. No. 26,723, issued to E. F. Averill et al. However, air diffusers of such a type, theretofore known in the art, have commonly had several inherent disadvantages, such as, for example, being large and bulky in size; being inefficient in operation; causing undesirable air flow directly away from the wall or ceiling in which the air diffuser is mounted; causing undesirable turbulence within the diffuser; being complicated in construction and operation, being difficult to install and adjust; or, being difficult and expensive to manufacture, and the like. It is an important object of the present invention to overcome such disadvantages.

Another object of the present invention is to afford a novel air diffuser for discharging air into a room through a wall or ceiling of such a room, wherein the parts thereof are constituted and arranged in a novel and expeditious manner effective to afford directional discharge of the air into the room laterally along the wall or ceiling in which the diffuser is mounted, without any substantial amount of air discharge from the diffuser directly out into the room in a direction normal to the aforementioned wall or ceiling.

Yet another object of the present invention is to afford a novel air diffuser of the aforementioned type, wherein the discharge pattern of the air may be quickly and easily adjusted in a novel and expeditious manner.

A further object of the present invention is to afford a novel air diffuser having a lanced plate providing apertures therein, the convolutions of which impart direction to the air in which the shape and arrangement of the apertures assure improved air distribution and less resistance to air flow from the diffuser than with air diffusers of this type heretofore known in the art.

Another object of the present invention is to provide an air diffuser having a plurality of deflector modules in which the individual modules may be quickly and easily assembled together to form a compact, unitary lanced plate as described above in a novel and expeditious manner, and in which the individual modules may be replaced or reoriented for directionally readjusting the air flow from the diffuser.

An object ancillary to the foregoing is to afford a novel air diffuser of the aforementioned type wherein the individual modules are releasably held in place in a frame by elongated fastening bars, which may be slid into and out of operative relation to the modules.

Yet anther object of the present invention is to provide a novel air diffuser in which a plate-like member is detachably secured to the wall or ceiling in a novel and expeditious manner whereby the plate may readily be extended outwardly from the ceiling several inches and held in this position to facilitate visual inspection and cleaning of the inside of the diffuser. A related object is to provide such an air diffuser in which the plate-like member, which embodies a plurality of lanced plates, when once extended away from the wall or ceiling, may be detached therefrom on one side and is hingedly secured at the opposite side so that it may readily be swung outwardly from the wall or ceiling to facilitabe replacement or reorientation of the plates.

Another object of the present invention is to afford a novel air diffuser of the aforementioned type, which is practical and efficient in operation and which may be readily and economically produced commercially.

Other and further objects of the present invention will be apparent from the following description and claims and are illustrated in the accompanying drawings which, by way of illustration, show the preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 2:
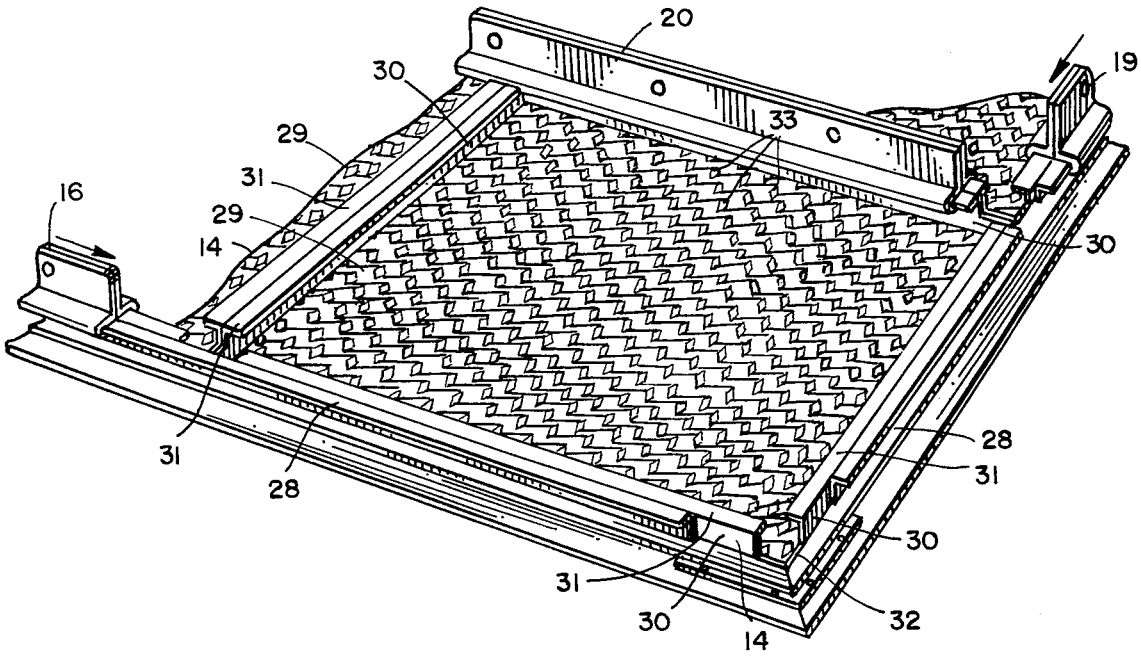
FIG. 2 is an enlarged, fragmentary perspective view showing the relationship between several of the air distribution panels, their supporting frame, and the fastening means used to secure the panels to the frame and to each other.

An air diffuser 1 embodying the principles of the present invention is shown in the drawings to illustrate the presently preferred embodiment of the present invention.

Figure 4:
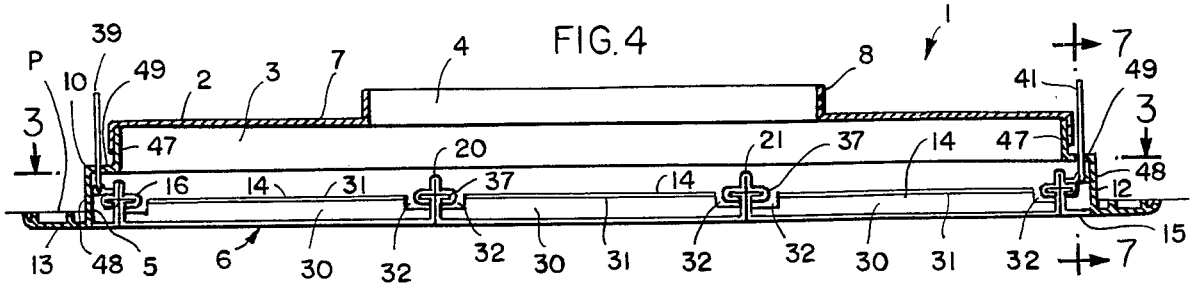
FIG. 4 is a transverse, sectional view taken substantially along the line 4—4 in FIG. 3.

The air diffuser 1 embodies, in general, a housing 2, defining an air flow chamber 3, and having an air inlet opening 4 in one side thereof, through which air may be fed into the chamber 3, and an air outlet opening 5 on the side thereof remote from the inlet opening 4, through which air may be discharged from the chamber 3; and an air deflecting unit 6 mounted in the outlet opening 5, FIG. 4, for determining the air flow pattern of the air discharged from the outlet opening 5, as will be discussed in greater detail hereinafter.

The housing 2 may be made of any suitable material, such as, for example, galvinized iron, aluminum, sheet steel or a suitable plastic material, and the like, and embodies a top wall 7 having an annular rim 8 projecting outwardly from the central portion thereof in position to define the inlet opening 4. The air diffuser 1 may be of any suitable shape. However, the preferred form of air diffuser 1 shown in the drawings is rectangular in transverse cross-section, and the housing 2 embodies four side walls 9, 10, 11 and 12 extending downwardly from the top wall and defining respective sides of the housing 2. A flange 13 extends around the outer periphery of the housing 2 and projects laterally outwardly from the lower edge portions of the side walls 9–12, remote from the top wall 7, in uniplanar relation to the outlet opening 5.

The housing 2 is of a type adapted to be inserted into a suitable opening, not shown, in a wall or ceiling of a room with the flange 13 disposed in abutting engagement with a face of such a ceiling or wall along a plane, such as the plane P indicated in FIG. 4. The rim 8 is adapted to be connected to a suitable source of air, such as, for example, to an air duct in an air distribution system, not shown, mounted in a wall or ceiling in which the housing 2 is disposed.

The air deflecting unit 6 embodies a plurality of air deflecting modules or panels 14 which may be formed or lanced as sections in a plate, and therefore integral, or as shown herein, may be individual modules which are releasably and removably mounted in side-by-side relation in a frame 15 by elongated fastening members or fastening bars 16, 17, 18, 19, 20 and 21, FIGS. 1 and 3, in a manner which will be discussed in greater detail presently. The bars 16–21, in the assembled unit 6, form a part of the supporting frame 15.

Figure 1:
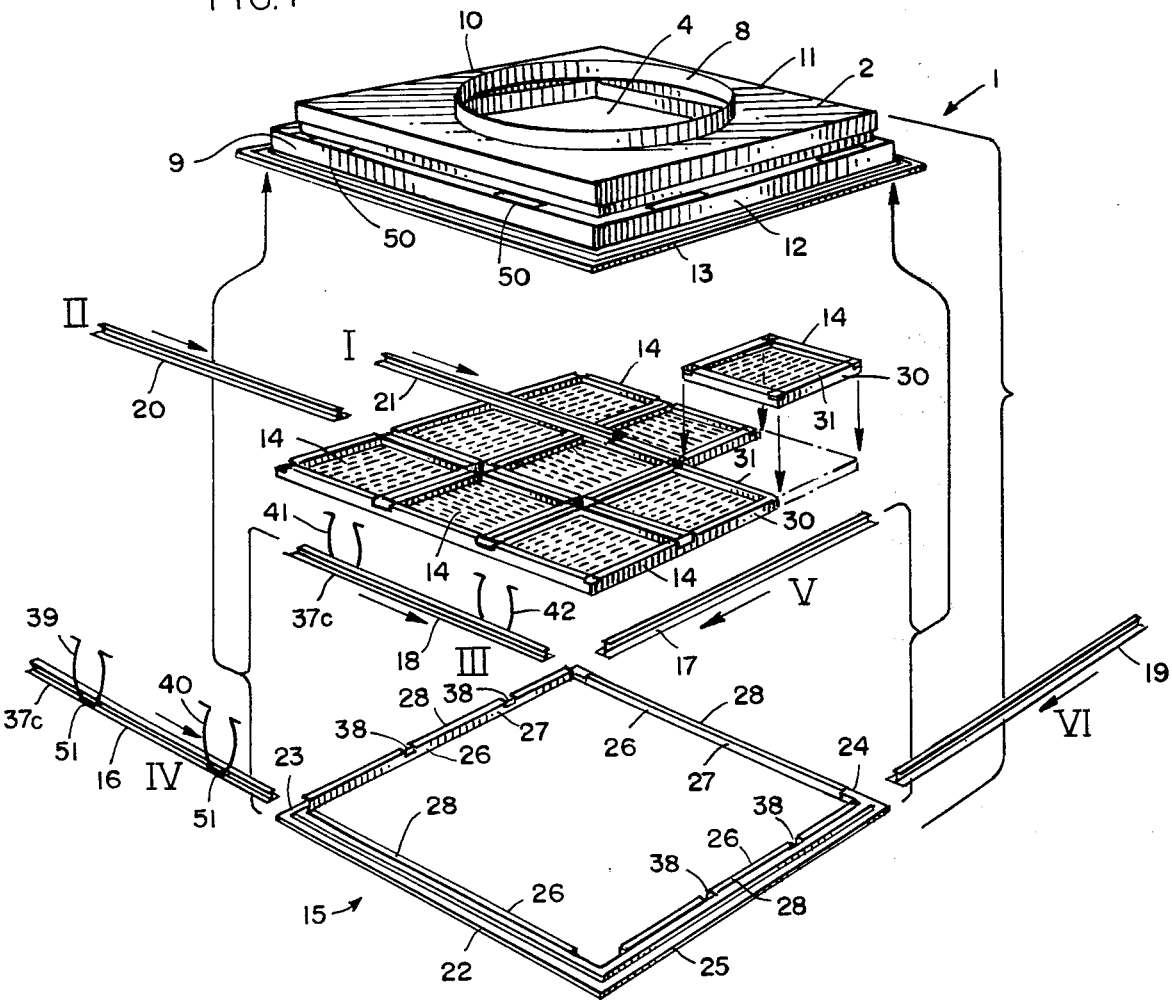
FIG. 1 is an exploded, perspective view of an air diffuser embodying the principles of the present invention.

The frame 15 is rectangular in shape, and embodies four elongated side members 22, 23, 24 and 25 disposed in end-to-end relation to each other to define the outer periphery thereof, FIG. 1. Each of the side members 22–25 embodies substantially inverted L-shaped members 26 extending along the inner edges thereof, with one leg of flange 27 of each member 26 projecting upwardly from the inner edge of the respective side member 22–25 in substantially perpendicular relation thereto, and with the other leg or flange 28 of each of the members 26 projecting outwardly from the upper edge portion of the respective leg 27 in substantially parallel relation to the respective side member 22–25.

The modules or panels 14 are preferably all identical in construction. In the preferred form of the invention shown in the drawings, each is square in shape, and each embodies a square plate 29 having the outer peripheral edge portions thereof bent inwardly to form the flange 30 and then unwardly to form the flange 31 substantially parallel to the face of the module, FIGS. 1 and 2, to form attaching means for mounting them in adjacent relationship in the main frame 15.

The modules 14 may be made of any suitable material, such as, for example, steel, aluminum or a suitable plastic material. However, preferably they are made from a suitable metal, such as aluminum. Each end of the flange members 30 and the inwardly bent portions 31 terminate short of the corner of its associated plate, thereby to afford notches 32, FIGS. 2, 4 and 9, for a purpose which will be discussed in greater detail presently.

Figure 10:
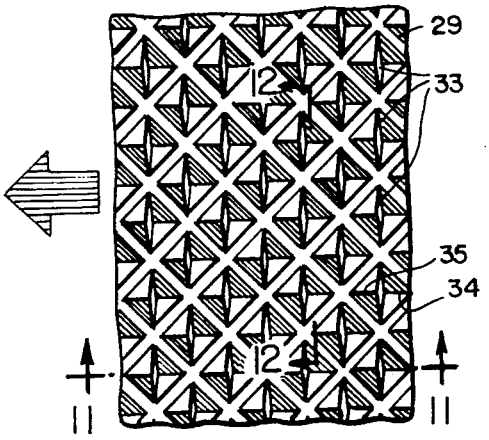
FIG. 10 is an enlarged, fragmentary plan view of a portion of one of the air distribution panels shown in FIG. 3.
Figure 11:
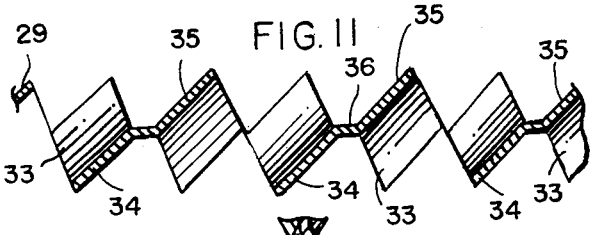
FIG. 11 is a detail, sectional view taken substantially along the line 11—11 in FIG. 10.
Figure 12:
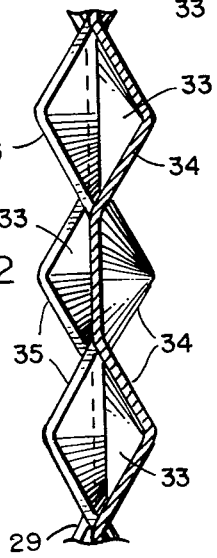
FIG. 12 is a detail, sectional view taken substantially along the line 12—12 in FIG. 10.
Figure 5:
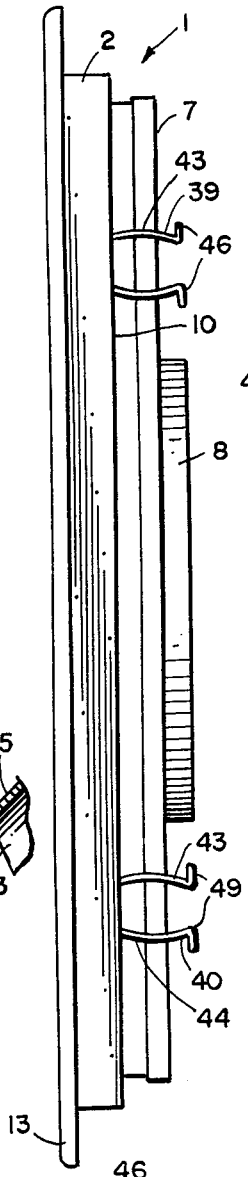
FIG. 5 is an elevational view showing the air diffuser, shown in FIG. 1, in its fully assembled form.

Each of the plates 29 has a plurality of spaced apertures 33 formed therein. The apertures 33 may be made in any suitable manner, but, preferably, are cut in the plate 29 in a suitable manner, such as, for example, by lancing the same. The apertures 33 in each plate 29 are defined by adjacent depressed portions 34 and elevated portions 35, FIGS. 10, 11 and 12 and the longitudinal axes of the passageways afforded by all of the apertures 33 are disposed at the same acute angle to the plane of the plate as shown at 36, FIG. 11. This acute angle, preferably is such that air passing through the apertures remains substantially parallel to the plane of the plates.

Figure 3:
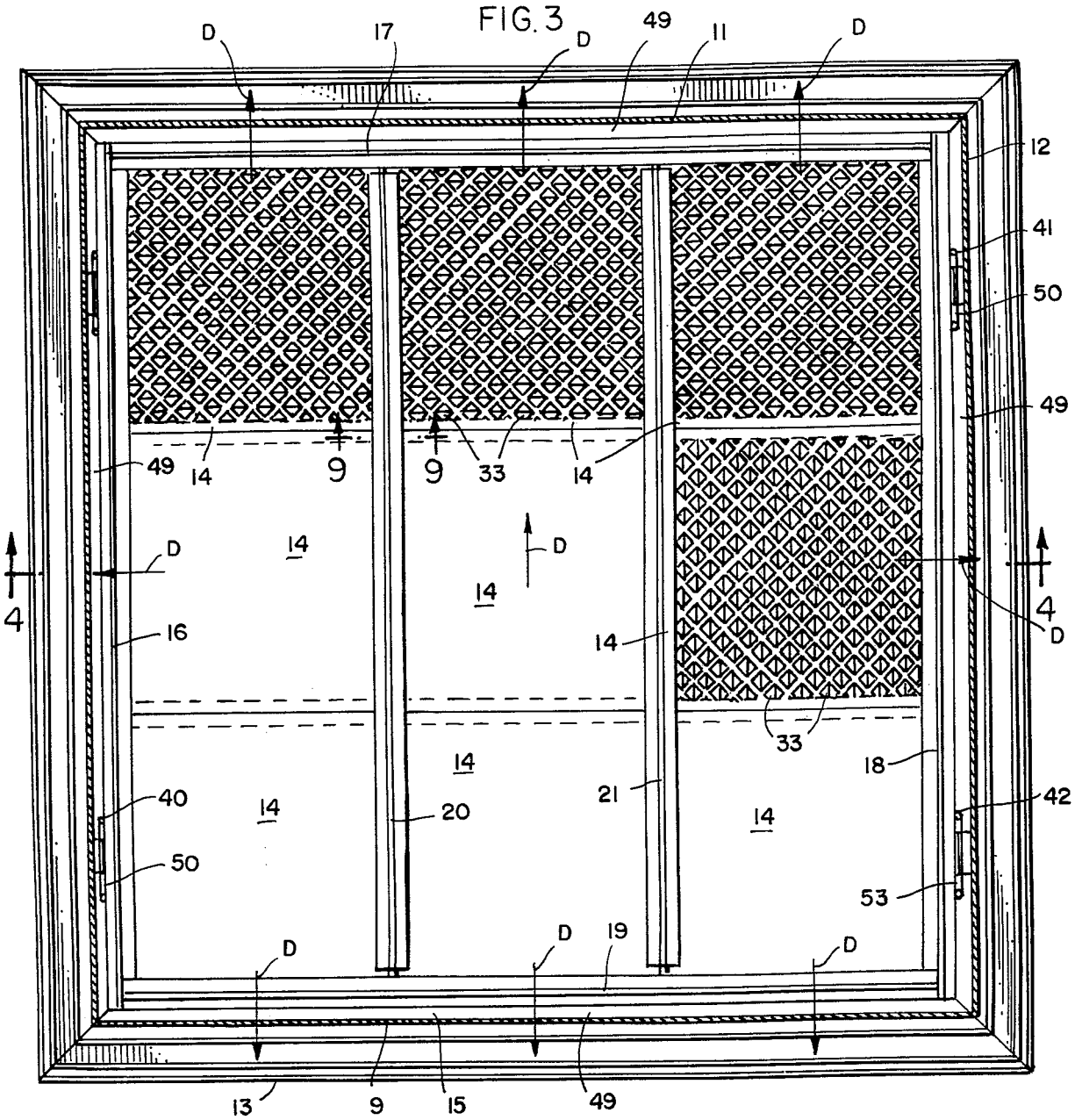
FIG. 3 is a plan-like sectional view taken along the line 3—3 of FIG. 4, showing the interior of the air diffuser, shown in FIG. 1, in its fully assembled form.

In assembling the air deflecting unit 6, the modules 14 are disposed in side-by-side, uniplanar relation to each other within the frame 15, as illustrated in FIG. 3. In such position, the adjacent flange members 30 of adjacent modules are disposed in abutting, parallel relation to each other, with the flanges 31 thereof disposed in outwardly projecting, uniplanar relation to each other, FIGS. 1 and 7. In the assembled air deflecting unit 6, the outer flange members 30 of athe outermost modules 14 are disposed in abutting, parallel relation to the adjacent frame members 26 of the supporting frame 15 with the adjacent flanges 31 and 28 of the modules 14 and the frame members 26, respectively, disposed in outwardly projecting, uniplanar relation to each other.

The supporting bars 16–21 are all identical in construction to each other, except that the bars 20 and 21 are shorter in length than the bars 16–19. Each of the bars 16–21 is of substantially inverted, T-shaped transverse, cross-sectional shape, and each has a T-shaped opening 37 formed in the lower face thereof and extending throughout the length of the respective bars 16–21. The openings 37 are defined by flanges 37*a* and 37*b* and an oppositely disposed body portion 37*c*, FIG.

9, the flanges being disposed in spaced relation to each other on the lower side of the bars 16–21. The supporting bars 16–21 may be made of any suitable material, such as, for example, steel, aluminum, or a suitable plastic, but preferably are made from aluminum, which can be either formed or extruded.

The air diffuser 1, shown in the drawings to illustrate the presently preferred embodiment of the present invention, embodies nine modules 14 disposed in side-by-side relation to each other. In the assembled air deflecting unit 6 of the air diffuser 1, the supporting bars 16–19 are disposed on the sides of the supporting frame 15 corresponding to the flanges 22–25, respectively, with the adjacent flanges 28 and 30 of the adjacent frame member 26 and flange 31, respectively, disposed in the openings 37 in the supporting bars 16–19. Similarly, in the assembled air deflecting unit 6, the supporting bars 20 and 21 are disposed on opposite sides of the innermost modules 14 in substantially parallel relation to the supporting bars 16 and 18, with the adjacent flanges 31 of the innermost modules 14 and of the modules 14 disposed adjacent to the respective opposite sides thereof, confined within the opening 37 in the respective supporting bars 20 and 21, FIGS. 3 and 4.

The supporting frame 15 of the air deflecting unit has two spaced notches 38 formed in the frame members 26 disposed on each of the flanges 23 and 25 thereof, FIG. 1. Respective pairs of the notches 38 disposed in the flanges 26 on opposite sides of the frame 15 are disposed in alignment with each other, and are so positioned that they are aligned with flange members 30 disposed on respective ones of the opposite sides of the innermost modules 14 which are disposed in parallel relation to the flanges 22 and 24 of the frame 15 in the assembled air deflector unit 6. With this construction, after the modules 14 have been placed in the aforementioned side-by-side relation within the frame 15, the supporting bars 16–21 may be mounted in operative position on the frame 15 in any suitable sequence, such as the sequence indicated by the Roman numerals I–VI shown in FIG. 1.

Thus, the supporting bar 21 may first be slid longitudinally through either one of the notches 38 appearing at the right side of the frame 15, as shown in FIG. 1, and then longitudinally along the flanges 31 of the modules 14 aligned therewith. Thereafter, the supporting bar 20 may be slid through either one of the notches 38 disposed at the left side of the frame 15, as shown in FIG. 1, into operative engagement with the flanges 31 aligned therewith. With the supporting bars 20 and 21 disposed within the frame 15, in operative engagement with the respective inner edges of the modules 14 disposed in alignment with the notches 38, the supporting bars 16–19 may then be slid longitudinally along the respective sides 22–25 of the frame 15 into the aforementioned operative engagement with the respective adjacent frame member 26 and flange 30, such movement of the supporting bars 16–19 being in any proper sequence, such as, for example, first the bar 18, then the bar 16, then the bar 17, and finally the bar 19, as indicated by the Roman numerals III–VI, in FIG. 1.

The resulting assembled air deflecting unit 6, as shown in FIG. 3, embodies the outer supporting members 16–19 disposed in surrounding relation to the modules 14 and securing the latter to the supporting frame 15, with the supporting bars 20 and 21 secured to the inner edge portions of two outermost rows of modules 14 and to the adjacent outer edge portions of the innermost row of modules 14 to thereby firmly secure the latter together and support the same within the frame 15.

Figure 9:
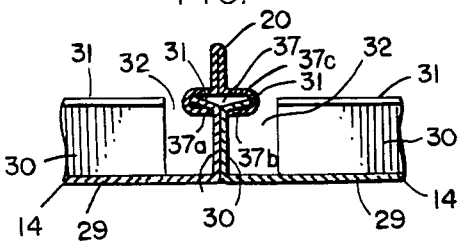
FIG. 9 is a fragmentary, detail sectional view taken substantially along the line 9—9 in FIG. 3.

It will be remembered that each of the flange members 30 and 31 on the modules 14 is cut away at the opposite end portions thereof to afford the notches 32, FIGS. 4 and 9. The notches 32 afford clearance, and define passageways through which the supporting bars 16–21 may pass during longitudinal sliding movement of the latter into and out of operative position relative to the modules 14.

Two substantially U-shaped or wishbone-shaped resilient clips 39 and 40 are pivotally or hingedly mounted in spaced relation to each other on the upper face of the body portion **37*c* of the supporting bar 16, FIG. 1. Similarly, two clips 41 and 42, which are identical to the clips 39 and 40, are hingedly connected to the upper face of the body portion 37*c* of the supporting bar 18.**

The clips 39–42 may be made of any suitable material, such as, for example, spring steel wire, and each embodies two elongated legs 43 and 44 projecting from respective opposite ends of a bight portion 45, the end portions 46 of the respective legs 43 and 44 remote from the bight portion 45, projecting outwardly away from each other to afford hooks. The legs 43 and 44 of each of the clips 39–42 are convex outwardly, away from each other between the end portions 46 and the attachment of the legs 43 and 44 to the bight portion 45, and the resilience of the clips 39–42 is such that it tends to urge the leg portions 43 and 44 thereof outwardly away from each other around the connection thereof to the bight portions 45.

Each of the side walls 9–12 of the housing 2 is somewhat Z-shaped in transverse cross-section, having an upper flange 47 and a lower flange 48 disposed in spaced, substantially parallel planes, with a mid portion 49 extending horizontally and connecting the lower edge of the flange 47 to the upper edge of the flange 48, FIG. 4. Each of the portions 49 of the side walls 10 and 12 have two aligned, spaced openings 50 extending therethrough for a purpose which will be discussed in greater detail presently.

Figure 6:
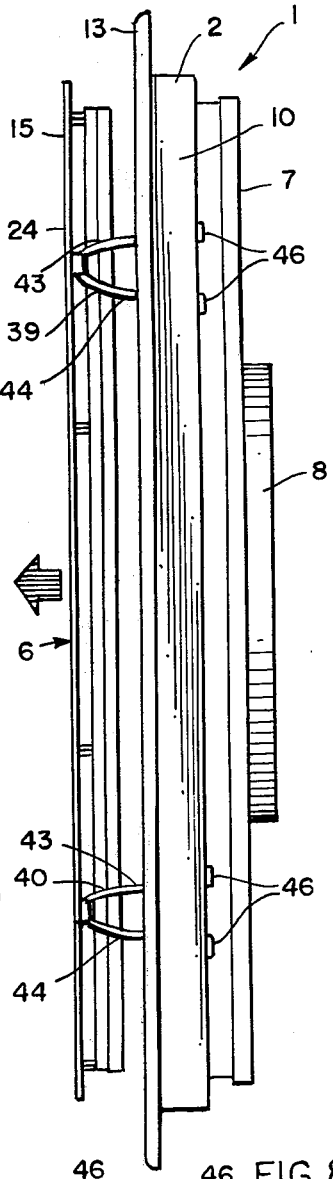
FIG. 6 is an elevational view, similar to FIG. 5, showing the air diffuser in partially disassembled position.
Figure 7:
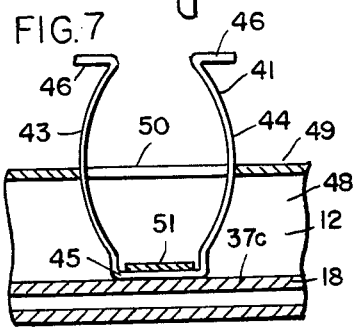
FIg. 7 is a detail sectional view taken substantially along the line 7—7 in FIG. 4.
Figure 8:
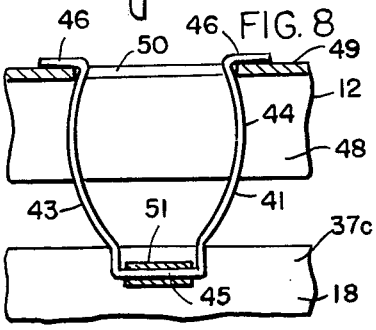
FIG. 8 is a detail, sectional view, similar to FIG. 7, but showing the parts of the air diffuser disposed in different position.

The clips 39 and 40 and the clips 41 and 42 are connected to the supporting bars 16 and 18, respectively, by suitable hinge members 51 disposed around the bight portions 45 thereof and secured to the upper face of the body portion 37c of the respective supporting bars 16 and 18, FIGS. 1, 7 and 8. The hinges 51 are so disposed on the supporting bars 16 and 18, that when the air deflecting unit 6 is to be disposed in operative position in the housing 2, wherein it is disposed in the outlet opening 5, with the outer face of the air deflecting unit 6 disposed in uniplanar relation to the outer face of the flange 13 on housing 2, as shown in FIG. 2, the legs 43 and 44 of the clips 39–42 may be manually pressed inwardly toward each other and the free ends thereof inserted into respective ones of the openings 50 in the housing 2. After the clips 39–42 have thus been inserted into the respective openings 50, continued inward movement of the air deflecting unit 6 into the housing 2 is effective to move the clips 39–42 into position wherein the outwardly bowed portions of the legs 43 and 44 are moved inwardly past deadcenter position relative to the respective openings 50 so that the clips 39–42 are effective to yieldingly hold the air deflecting unit 6 in fully assembled position in the housing 2, as illustrated in FIGS. 4 and 7. If it is desired to partially withdraw the air deflecting unit 6 from the housing 2, for cleaning or inspection purposes, or the like, the air deflecting unit 6 may be manually pulled outwardly away from the housing 2 into position wherein the end portions 46 of the respective clips 39–42 are disposed in overlapping relation to the upper faces of the portions 49 of the side walls 10 and 12 defining the ends of the respective openings 50, FIGS. 6 and 8, the clips 39–42 then being capable of supporting the air deflecting unit 6 in outwardly spaced, substantially parallel relation to the housing 2, as illustrated in FIG. 6.

If it is desired to remove the air deflecting unit 6 a greater distance from the housing 2, for cleaning the same or for the purpose of repositioning the modules 14 therein, or the like, this may be readily accomplished by manually compressing the legs 43 and 44 of the clips 39–42 toward each other a sufficient distance to withdraw the end portions 46 thereof through the respective openings 50 in which the clips 39–42 are disposed and then completely remove the air deflector unit 6 from the housing 2.

On the other hand, if it is desired to merely swing the air deflecting unit 6 outwardly away from the housing 2, while still maintaining interconnection of the air deflecting unit 6 and the housing 2, this, also, may be readily accomplished by compressing the legs 43 and 44 on the clips disposed on one of the bars 16 or 18, such as, for example, the bar 16, to thereby disengage the two clips, such as the clips 39 and 40 from the housing 2. Thereafter, the air deflecting unit 6 may be swung outwardly around the clips 41 and 42 into any position between that shown in FIG. 6, wherein the air deflector unit 6 is disposed in substantially parallel relation to the housing 2, and a position wherein the air deflecting unit 6 is disposed in substantially uniplanar relation to the housing 2 as shown in FIG. 8. Normally, when the air diffuser 1 is mounted in a ceiling, the last mentioned open position of the air diffuser is that shown in FIG. 8, wherein it hangs down from the housing 2. In any of the latter positions, the air deflecting unit 6 may be suspended from the housing 2 by the two clips, such as the clips 41 and 42, remaining attached to the housing 2, irrespective of whether the air diffuser 1 is mounted in a ceiling or a wall or a room.

In mounting the modules 14 in the air deflecting unit 6, they may be so positioned or oriented that the flow from any individual module is in any one of four directions transversely across the face of the air deflecting unit 6. A typical air flow pattern from the air deflecting unit 6 is illustrated by the directional arrows D in FIG. 3. However, as will be appreciated by those skilled in the art, this is merely by way of illustration and not by way of limitation, and any desired air flow pattern may be afforded by turning the modules 14 into the position necessary to effect such a pattern. If, after the air diffuser 1 is completely assembled, it is desired to readjust or reorient any or all of the modules 14 in the air deflecting unit 6, this may be readily accomplished either by completely removing the air deflecting unit 6 from the housing 2, or by swinging it outwardly into the position wherein it is supported from the housing 2 by two of the clips 39–42, such as, for example, the clips 41 and 42, as previously discussed, to thereby render the inner or upper face of the air deflecting unit 6 accessable to the operator.

Thereafter, by removing the supporting bars 16–21, as required, to free the modules 14, which it is desired to reposition, such modules may be removed from the air deflecting unit 15, turned into the desired new position, and the removed ones of the bars 16–21 may then be reinserted into operative position on the frame 15. For example, if it were desired to reorient the upper center module 14 as viewed in FIG. 3, it would be necessary to first remove the supporting bar 17 so as to uncover the notches 38 in the frame member 26 attached to the flange 23 and then remove the supporting bars 20 and 21 and, thereafter, the supporting bar 17, and the air deflecting unit 6, again, would be in assembled condition. Others of the modules 14 can be similarly reoriented by removing the necessary ones of the supporting bars 16–21, so as to free the modules which are to be reoriented. Of course, if desired, all of the supporting bars 16–21 may be removed from the frame 15 whenever any of the modules 14 are to be readjusted.

From the foregoing it will be seen that the present invention affords a novel air diffuser wherein the directional air flow is controlled by a relatively thin plate structure which affords a minimum of resistance to the flow of air therethrough.

Also, it will be seen that the present invention affords a novel air diffuser wherein the passages through which the air flows from the diffuser into the room are such that they direct the air in a path which is substantially parallel to the plane of the face of the diffuser. With such construction, a minimum of resistance to such air flow is afforded, and a minimum of turbulance is caused within the air chamber 3.

In addition, it will be seen that the present invention affords a novel air diffuser wherein substantially the entire outer face of the air discharge portion thereof is afforded by modules either unitary or individual, which are removably mounted in a novel and expeditious manner, and which may be quickly and easily readjusted, in a novel and expeditious manner, for adjusting or varying the air flow pattern from the air diffuser.

The invention provides a construction wherein the air leaving the diffuser is given direction as it leaves rather than before or after. In some prior diffusers imperforate plates or other means may be used to give direction to the air before it leaves the air chamber, thereby creating turbulence in the chamber, and the thus directed air has that direction altered as it leaves the diffuser apertures, such as a perforated plate. When the direction of the air flow is given as the air leaves the diffuser, such as in the present invention, the direction of air flow is not altered but continues substantially in the desired direction.

Also, it wil be seen that the present invention affords a novel air diffuser which is practical and efficient in operation, and which may be readily and economically produced commercially.

Thus, while I have illustrated and described the preferred embodiment of my invention, it is to be understood that this is capable of variation and modification, and I, therefore, do not wish to be limited to the precise details set forth, but desire to avail myself of such changes and alterations as fall within the purview of the following claims.

I claim

1. An air diffuser for distributing air into a room from the supply duct of an air distribution system, comprising, a. a housing
1. having
a. an air inlet opening at one side thereof, and
b. an air outlet opening at the opposite side thereof and
2. defining an air chamber through which air may flow from said inlet opening outwardly through said outlet opening,
b. an air deflector unit extending across said outlet opening and forming the outer face thereof, said unit including
1. a plurality of air deflector sections and
2. a plurality of apertures in each section, each of said apertures being formed by adjacent depressed and elevated portions lanced in the face of said unit, wherein the surfaces of said portions are inclined at an acute angle with respect to the plane of the section, and the areas between all of the apertures remain as an integral part of said face, whereby
c. to impart a direction to the flow of air from said chamber, as it leaves said chamber, which is substantially parallel to the plane of said section.

2. The combination of elements defined in claim 1, wherein each of said deflector sections is an individual unit capable of being oriented to impart a multi-directional air flow from said air chamber.

3. The combination of elements defined in claim 1, including means for selectively supporting said air deflector unit in
a. one position wherein it extends across said outlet opening in abutting engagement with said housing, and
b. a second position wherein it extends across said outlet opening in outwardly spaced relation to said housing.

4. The combination of elements defined in claim 3, including means for supporting said air deflector unit in a third position wherein it is supported only along one side thereof, thereby permitting the unit to hang downwardly.

5. An air diffuser for distributing air into a room from the supply duct of an air distribution system, comprising
a. a housing
1. having
a. an air inlet opening at one side thereof, and
b. an air outlet opening at the opposite side thereof, and
2. defining an air chamber through which air may flow from said inlet opening outwardly through said outlet opening, and
b. an air deflector unit extending across said outlet opening and forming the outer face thereof and including a plurality of panels removably mounted in side-by-side substantially uniplanar relation to each other across said outlet opening,
c. each of said panels comprising a plate having a plurality of apertures therein, each aperture being formed by adjacent depressed and elevated portions lanced in the face of the plate, wherein the surfaces of said portions are inclined at an acute angle with respect to the plane of the plate, and the areas between all of the apertures remain as an integral part of said plate, and
d. said openings affording the only passageways for discharging air outwardly through said outlet opening from inside said housing.

6. An air diffuser as defined in claim 5, and in which
a. said panels are movable into various positions relative to said outlet opening for varying the flow pattern of air discharged through said outlet opening from said housing.

7. An air diffuser for distributing air into a room from a supply duct of an air distribution system, comprising
a. a housing
1. having
a. an air inlet opening at one side thereof and
b. an air outlet opening at the opposite side thereof and
2. defining an air chamber through which air may flow from said inlet opening outwardly through said outlet opening
b. air deflector means extending across said outlet opening and forming the outer face thereof,
c. said air deflector means comprising,
1. a plurality of panels, and
2. means for supporting said panels in side-by-side substantially uniplanar relation to each other,
d. each of said panels comprising
1. a plate having a plurality of apertures therein, each aperture being formed by adjacent depressed and elevated portions lanced therein, wherein the surfaces of said portions are inclined at an acute angle with respect to the plane of the plate, and the areas between all of the apertures remain as an integral part of said plate, and
2. flange members extending along the outer periphery of said plate, and
e. said last mentioned means comprising a frame
1. mounted on said housing in position to extend across said outlet opening, and
2. having slidably mounted supporting members slidable into and out of operative relation to said flange members,
f. said supporting members being operable to support said panels within and from said frame when said supporting members are disposed in said operative relation to said flange members.

8. An air diffuser as defined in claim 7, and in which
a. said flange members
1. are substantially L-shaped, and
2. project from the outer periphery of respective ones of said plates with
a. one leg thereof projecting away from said plate, and
b. another leg thereof projecting inwardly over said plate in spaced relation thereto,
b. said flange members on adjacent sides of adjacent ones of said panels are
1. disposed in side-by-side relation to each other,
2. with said other legs thereof projecting outwardly away from each other, and
c. certain of said supporting members are disposed in said operative relation to said other legs of said flange members that are disposed in said side-by-side relation to each other.

9. An air diffuser as defined in claim 8, and in which
a. others of said supporting members are disposed in said operative relation to said other legs of said flange members that are disposed at the outer periphery of said air deflector means.

10. An air diffuser as defined in claim 9, and in which
a. said supporting members
1. comprise elongated members having openings, which are substantially T-shaped in transverse cross-section, extending longitudinally along one side thereof, and 2. include spaced flanges
   a. defining one side of respective portions of said openings,
   b. for engaging said other legs of said flange members disposed in said openings.

11. An air diffuser as defined in claim 7, and which includes a. means for selectively supporting said deflector means in
   1. one position wherein the latter extends across said outlet opening in abutting engagement with said housing, and
   2. another position wherein said deflector means extends across said outlet opening in outwardly spaced relation to said housing.

12. An air diffuser as defined in claim 7, and in which a. said housing includes portions having openings therethrough, and
b. said air deflector means includes substantially U-shaped resilient members
   1. having bight portions thereof hingedly connected to respective opposite sides of said frame, and
   2. having leg portions disposed on opposite sides of said bight portions and having
      a. one position wherein the central portions thereof are disposed in said openings in said plate members in frictional engagement with the latter for yieldingly holding said deflector means in abutting engagement with said housing, and
      b. another position wherein the end portions thereof remote from said bight portions are disposed in said openings in said housing portions in hooked engagement with the latter for supporting said deflector means in outwardly spaced relation to said housing.

13. An air diffuser as defined in claim 12, and in which a. said resilient members on one side of said frame are releasable from said housing portions to thereby free said deflector means for pivotal movement around said bight portions of said resilient members on the opposite side of said frame between
   1. one position wherein said deflector means extends across said outlet opening in abutting engagement with said housing, and
   2. another position wherein said deflector means are supported by said last mentioned resilient members in outwardly projecting relation to said outlet opening.

14. An air diffuser for distributing air into a room from the supply duct of an air distribution system, comprising, a. a housing
   1. having
      a. an air inlet opening at one side thereof, and
      b. an air outlet opening at the opposite side thereof, and
   2. defining an air chamber through which air may flow from said inlet opening outwardly through said outlet opening,
b. an air deflector panel extending across said outlet opening and forming the outer face thereof, and
c. a plurality of apertures in the plane of said panel, each said aperture being formed by adjacent depressed and elevated portions lanced in said panel wherein the surfaces of said portions are inclined at an acute angle with respect to the plane of the panel, and the areas between all of the apertures remain as an integral part of the panel, thereby
d. to impart a direction to the flow of air from said chamber and through said apertures which is substantially parallel to the plane of said panel.

* * * * *